United States Patent [19]

Buttner

[11] 4,288,670

[45] Sep. 8, 1981

[54] ELECTRICAL CONDUCTOR ALIGNMENT AND RETAINING ASSEMBLY

[76] Inventor: Horace J. Buttner, P.O. Box 487, North Harbor City, Calif. 90710

[21] Appl. No.: 95,707

[22] Filed: Nov. 19, 1979

Related U.S. Application Data

[63] Continuation-in-part of Ser. No. 873,030, Jan. 22, 1978, Pat. No. 4,175,222, which is a continuation of Ser. No. 720,319, Sep. 3, 1976, abandoned.

[51] Int. Cl.[3] ..... H01H 13/04

[52] U.S. Cl. ..... 200/303; 200/16 A; 200/281

[58] Field of Search ..... 200/303, 239, 238, 275, 200/280, 281, 159 R, 16 A

[56] References Cited

U.S. PATENT DOCUMENTS

| | | | |
|---|---|---|---|
| 3,624,320 | 11/1971 | Eberhart | 200/303 |
| 3,878,344 | 4/1975 | Lockard | 200/303 |
| 4,055,736 | 10/1977 | Congelliere | 200/159 R |

*Primary Examiner*—Willis Little

*Attorney, Agent, or Firm*—Pollock, Vande Sande & Priddy

[57] ABSTRACT

An assembly for retaining electrical conductor end portions within a surrounding housing of an electrically operated device, including a plurality of spaced pin members extending between first and second housing portions, with pairs of the pin members located on opposite sides of conductor end portions located within the housing. The conductor end portions are, in turn, attached to contact terminals which are formed with an end portion located adjacent to the attached conductor having a width appreciably greater than a distance defined by a transverse gap extending between the pin members extending on either side of the conductor end portion, whereby tensional stresses applied to the conductor draw the attached contact terminal into abuting engagement with the pair of pin members, preventing longitudinal withdrawal of the contact between the pin members.

11 Claims, 16 Drawing Figures

ELECTRICAL CONDUCTOR ALIGNMENT AND RETAINING ASSEMBLY

DESCRIPTION

Cross-Reference to Related Applications

The present application is a continuation-in-part of copending application Ser. No. 873,030, filed Jan. 22, 1978, now U.S. Pat. No. 4,175,222, by Horace Judson Buttner which, in turn, is a continuation of application Ser. No. 720,319, filed Sept. 3, 1976 by Horace Judson Buttner and now abandoned. The subject matter of application Ser. No. 873,030 and Ser. No. 720,319 is hereby incorporated by reference.

TECHNICAL FIELD

The present invention relates to an assembly for preventing inadvertent withdrawal of an electrical conductor end portion from a surrounding housing assembly.

BACKGROUND ART

Electrically operated devices, for example, electrical switches, electrical plug assemblies, electrical light sockets and even simple electrical couplings generally include a housing and have at least one electrical conductor cable extending outside the housing and have an end portion attached to an electrical contact which is within the housing. However, a significant problem confronting such prior art electrical devices is the tendency for the electrical contact to become misaligned and even pulled entirely from the housing as a result of tensional and/or flexural forces applied to the attached conductor cable.

A variety of structures have been suggested for retaining the electrical contact in its properly aligned position within its surrounding housing. For example, it has been suggested that an aperture leading into the housing include a portion having a diameter which is effectively less than the diameter of the conductor cable passing through the aperture, thereby clamping or pinching the conductor cable to prevent inadvertent withdrawal of the cable from the housing. Such an assembly has proven less than completely satisfactory in failing to provide structure for maintaining proper alignment of an electrical contact positioned within an electrical housing and attached to a conductor cable secured as suggested hereabove.

A more sophisticated approach to retaining the electrical conductor cable end portion within a surrounding electrical housing assembly suggests positioning a conically-shaped pressure element within a housing, with the pressure element surrounding a portion of an electrical conductor cable extending into the housing. Tensional stresses applied to an exterior portion of the cable act to wedge the pressure element into contact with the housing, causing the pressure element to create a gripping attachment with the electrical cable to prevent withdrawal of the cable from the housing. While such a pressure member may prevent withdrawal of the cable from the housing, the pressure member cannot prevent lateral stresses acting on the cable from affecting the alignment of an electrical contact positioned within the housing and attached to the cable. Furthermore, because some longitudinal movement of the pressure member is usually necessary to create the wedging action with the housing, the contact attached to the cable can become longitudinally misaligned before the pressure member becomes effective.

A yet further approach suggested in some prior art assemblies is to construct each of the housing members with a confronting surface which presses tightly against opposite side portions of the electrical contact in order to clamp the electrical contact into its proper position within the housing assembly. Such housing assemblies are relatively expensive to manufacture due to the close tolerances which must be maintained in order to provide a sufficient clamping force against the electrical contact and attached conductor end portion extending into the housing. More importantly, such housing assemblies can often only be employed with the specific contact and conductor for which the confronting end surfaces were originally molded. As a result, it is generally difficult, if not impossible, to modify the contact or conductor as may be desired.

As will become clear hereafter, the present invention overcomes the many disadvantages inherent in the known prior art as discussed hereabove, as well as additional disadvantages confronting the known prior art assemblies.

DESCRIPTION OF THE INVENTION

The present invention relates to an assembly for preventing inadvertent withdrawal of an electrical terminal from within a surrounding housing assembly of an electrically operated device, wherein the housing assembly includes first and second housing portions arranged in adjacently disposed relationship to one another. The electrical terminal is supported within the housing assembly and includes a portion forming an electrical attachment with an electrical conductor, at least a portion of which conductor extends beyond said housing assembly. A plurality of pin members are each attached to one of the housing portions and extend into a corresponding recess formed in the remaining housing portion. At least one pair of spaced pin members is arranged on opposite sides of the electrical conductor and define a linear gap extending between the pair of pin members. The linear gap is specifically chosen to be of a distance which is appreciably less than a width of a portion of the electrical terminal positioned on an opposite side of the pair of pin members from that portion of the electrical conductor which extends beyond the housing assembly. As a result, the pair of pin members prevent withdrawal of the electrical terminal therebetween.

The foregoing class of devices is exemplified by a preferred pushbutton switching assembly which is capable of selectively providing an electrical connection between a pair of electrical conductor cables each attached to an electrical contact arranged within the switch housing assembly. The housing assembly includes a pair of openings arranged to allow the pair of electrical conductors assemblies to enter the housing substantially between first and second, separable housing members, with each of the conductors electrically engaging one of the electrical contacts positioned within the housing. Each electrical contact may constitute an integral portion of an electrical conductor cable, as may be achieved by deforming or coining the end portion of the conductor cable into a coined end electrical contact. Alternatively, one or more stamped contact terminals may be positioned within the housing, with the stamped contact terminal integrally joining a first portion of an electrical conductor assembly which, in turn, joins a second portion of the conductor assembly at a location either inside or outside of the assembled housing.

Spaced pin members in a plurality of pairs are each attached to one of the housing members and project into a corresponding plurality of spaced recesses formed in the remaining housing member, with a portion of each electrical conductor assembly extending through a gap extending between at least one pair of spaced pin members, which gap extends substantially transversely to the longitudinal axes of the pin members. The pin members positioned in pairs on opposite sides of a respective electrical conductor are spaced from one another a linear distance which is appreciably less than a width of a portion of the contact electrically attached to the respective electrical conductor assembly extending between the pair of pin members. As a result, tensional forces applied to exterior portions of the conductor cable tend to draw the electrical contact attached to the conductor into abutting engagement with the pair of spaced pin members, extending on either side of the conductor, with the pin members thus providing a positive stop to prevent withdrawal of the electrical contact therebetween. Whether the contact and conductor are integrally formed or mechanically attached as by crimping and soldering, it is necessary that a portion of the electrical contact, preferably adjacent to the junction of the attached electrical conductor be formed with a width which is appreciably greater than a linear gap defined between the substantially parallel extending pin members positioned on opposite sides of the conductor. Alternatively, an integrally formed electrical contact and conductor may have a substantially uniform width which is greater than the linear distance defined between the spaced pin members. In such an instance, a pair of notches or grooves is formed on opposite sides of integral conductor and contact member at the approximate junction of the contact and conductor portions, with the grooves being of sufficient size to allow a portion of the integral member to just fit between the spaced pin members. Tensional stresses applied to the conductor portion function to draw portions of the grooves into abutment with the pin members, preventing longitudinal movement of the integral conductor contact member in either direction.

The present invention further includes a retaining assembly for preventing angular movement of the electrical contacts in a plane extending substantially transverse to the longitudinal axes of the pin members. In the preferred embodiment, a further plurality of additional pairs of pin members each extending parallel to one another between the cover and head members. Such additional pairs of pin members are positioned on opposite sides of each electrical contact at a location adjacent to an end portion of the respective electrical contact remotely positioned from the portion of the contact joined to one of the electrical conductors. Each additional pair of pin members is linearly spaced from one another a distance which is substantially equal to a width of the electrical contact extending therebetween. Because each additional pair of pin members is located on opposite sides of one of the electrical contacts, they prevent the contact from undergoing angular movement as a result of flexural forces applied to an attached electrical conductor. In a further embodiment, the additional pin members may be eliminated, with each of the electrical contacts positioned in a shallow recess formed in one of the switch housing portions. Each shallow recess has a configuration sufficiently similar in shape and size to the configuration of at least a portion of the electrical contact, whereby the side wall portions of each recess can prevent angular misalignment of an electrical contact positioned therein.

It is, of course, within the scope of the present invention to mount the pin members on one housing member and have each of the pin members extend into a separately aligned recess formed in another housing member. Furthermore, each of the pin members may or may not form an interference fit with its respective recess; rather, selected pins may be sized to form an interference fit, while the remaining pins are sized to freely enter their respective recesses. Alternatively, a conventional fastening assembly may be employed to retain the housing portions in their assemblied positions, with all of the pin members freely slidable supported within their respective recesses.

An arrangement wherein the pin members serve the dual functions of aligning the electrical contacts and maintaining the housing portions in their assembled positions is considered preferably to alternative arrangements, in that, the number of components forming the housing assembly can be kept at a minimum, while ensuring a proper fit is maintained between the various components of the electrical switch located within the housing.

For purposes of explanation only, the present invention is illustrated in conjunction with a pushbutton switch assembly of the type defined in copending application Ser. No. 873,030 incorporated by reference hereabove. However, the present invention is not to be limited to use with only a pushbutton switch assembly; rather, the present invention is equally adaptable for use with any type of electrical device which may employ one or more electrical contacts arranged within the housing assembly and engageable with an electrical conductor cable.

BRIEF DESCRIPTION OF DRAWINGS

A preferred embodiment of the present invention will now be described in more detail in the following portions of this specification when taken in conjunction with the attached drawings in which the reference characters identify identical apparatus, and in which.

FIRST MODE FOR CARRYING OUT THE INVENTION

Figure 1:
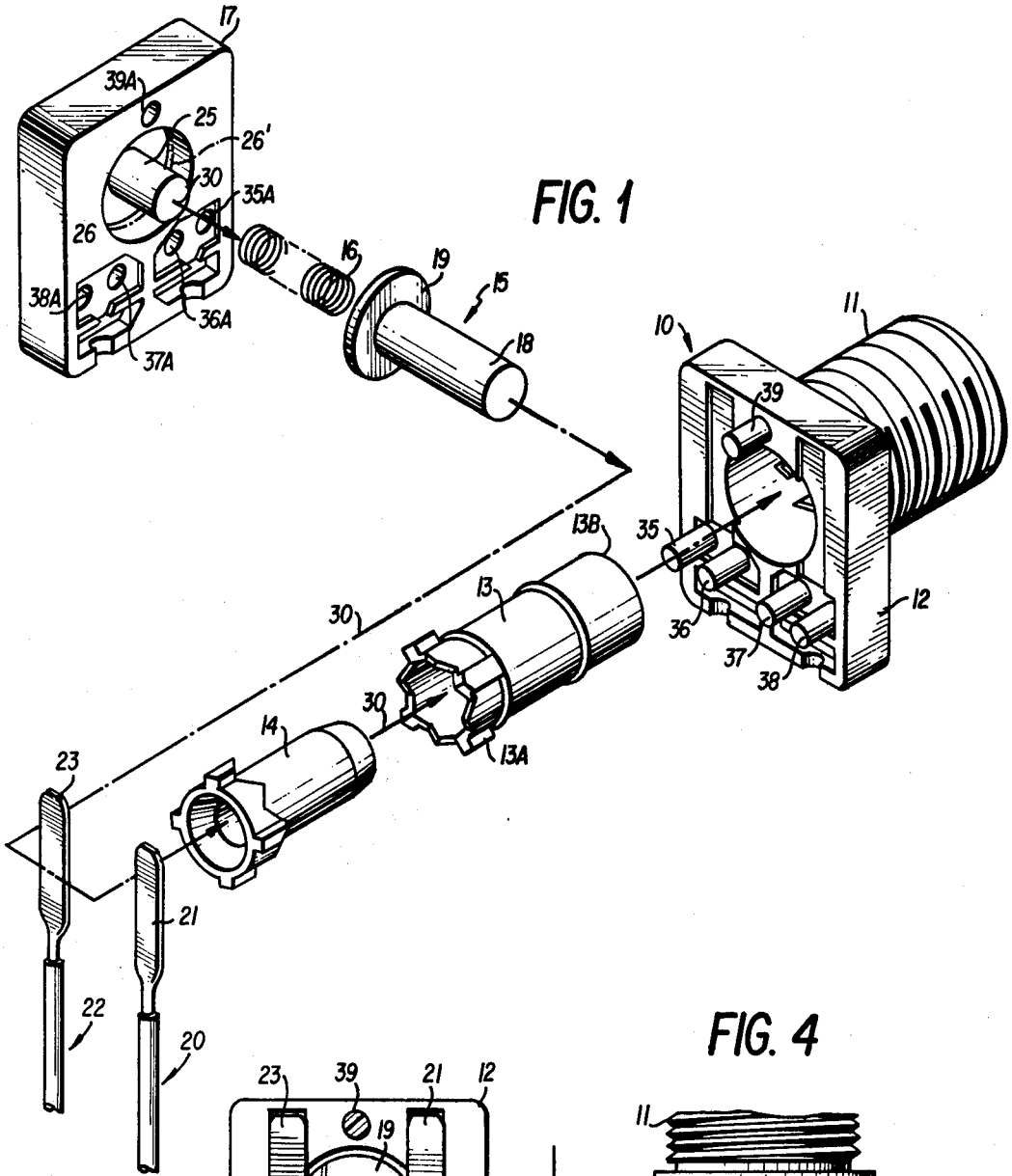
FIG. 1 is an exploded view of a pushbutton switch assembly incorporating a first embodiment of the present invention.

FIG. 1 is an exploded view of the several components of a switch embodying the present invention. More particularly, the switch comprises a housing 10 including an externally threaded barrel 11 having a longitudinal axis 30 and an attached head portion 12 which extends generally transverse to the axis 30. The head portion 12 includes a plurality of pins 35–39, whose purpose will be discussed hereinafter. A generally cylindrical plunger 13 is arranged for sliding movement within the barrel 11 along the axis 30 with one end 13B available for projection along the axis 30. Fitted within the plunger 13 is a generally cylindrical sleeve 14 also aligned on axis 30 and arranged, by apparatus to be described, for motion longitudinal of the axis 30 and further arranged for rotational movement about the axis 30. A moveable contact 15 is arranged to fit within the cylindrical sleeve 14 for motion along the axis 30. The moveable contact 15 comprises a cylindrical, thimble-like configuration having a generally cylindrical portion 18 and an annular flange 19 attached at one end thereof. A coil spring 16 is arranged to fit within the cylindrical portion 18 of the contact 15 and to bear against the contact 15 and a guide stud 25. The guide stud 25 comprises a portion of a cover 17 and serves to partially define an annular recess 26 in the cover 17. Additional recesses 35A–39A are included in the cover 17 for mating with the pins 35–39 of the head 12. The interference fit between the pins 35–39 and the recesses 35A–39A secure the cover 17 to the head 12 when the switch is assembled as well as locate the cover 17 properly with respect to the head 12.

The function of the switch is to selectively make or break an electrical connection between a pair of conductors, such as conductors 20 and 22. To this end, each of the conductors 20 and 22 is provided with a coined end 21 and 23, respectively. The coined ends are located so that the shoulders are located by a pair of the pins such as 35–36 or 37–38 to properly locate the conductors 20 and 22 within the switch 10 (see in this regard FIG. 3). To make the electrical connection, the flange 19 of the contact 15 bridges the coined ends 21, and 23. Of course, at least the flange 19 (and preferably the entire moveable contact 15) is formed of an electrically and thermally conducting material.

Figure 3:
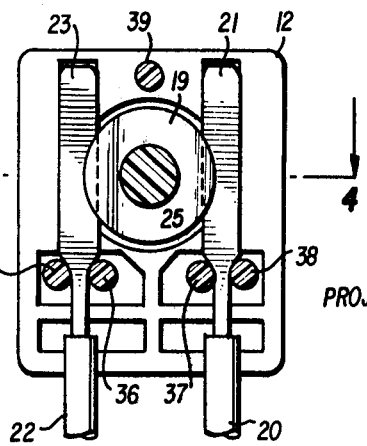
FIG. 3 is a cross-section taken on the lines 3—3 in FIG. 2.
Figure 4:
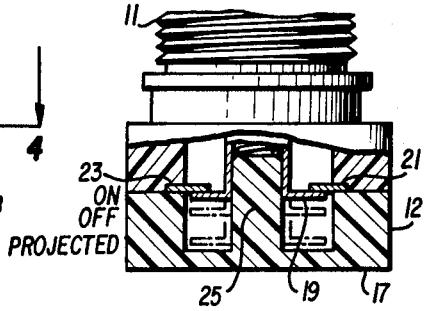
FIG. 4 is a section of the inventive switch assembly taken on the lines 4—4 in FIG. 3.
Figure 2:
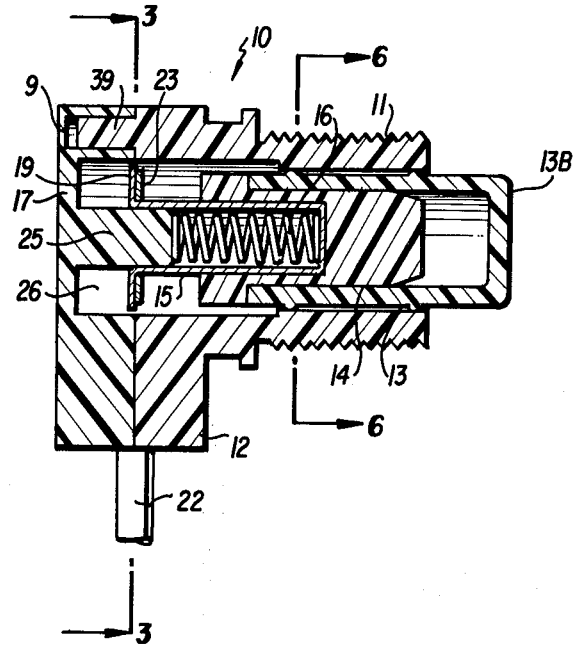
FIG. 2 is a cross-section of the switch assembly taken through an axis thereof.

FIG. 2 is a cross-section of the switch in the closed condition, and FIG. 3 is a section taken on the lines 3—3. FIG. 4 illustrates still a different section of the switch taken on the lines 4—4. FIG. 4 illustrates the switch in the closed condition, wherein the flange 19 of the moveable contact 15 bridges the coined ends 21 and 23 of the conductors 20 and 22 to establish an electrical connection. The legend "ON" indicates that when the flanged end 19 is in the condition shown, an electrical connection is established and the switch is "ON." The adjacent dotted showing of flange 19, corresponding to the "OFF" legend, indicates that this is a second position of contact 15 wherein the switch is in the "OFF" condition, wherein no electrical connection exists between conductors 20 and 22. Finally, a second dotted showing of flange 19, associated with the legend "PROJECTED" indicates that as the plunger 13 is depressed, the flange 19 reaches the position shown. Actually, the contact 15 has two stable positions, the "ON" and "OFF" positions. The first of these positions is achieved through the action of the coil spring 16 acting against the stud 25 and biasing contact 15. This biasing force establishes a solid electrical connection between the flange 19 and the coined end contacts of conductors 21 and 23 as controlled by the spring design force.

The second stable condition of the switch is achieved through the operation of a ratchet mechanism.

As best shown in FIG. 1, head 12 is formed with a pair of shallow recesses 70 and 71, each having a configuration substantially similar to the conductor ends 23 and 21, respectively. During assembly, each conductor end 23 and 21 is positioned between a pair of pins 35–36 or 37–38 and is pressed into one of the recesses 70 or 71. The recesses include side wall portions which selectively engage side portions of the flat conductor terminals to prevent the terminals from inadvertent angular movement in a plane extending transversely to axis 30 about either of the pins extending on opposite sides thereof.

As shown in FIG. 1, plunger 13 carries a plurality of lugs 13A (as shown in FIG. 1, four lugs are provided). Corresponding extended recesses or ways are provided in the interior of the barrel 11 to allow the plunger 13 to move parallel to the axis 30, with the lugs preventing rotation of the plunger 13 as will be described. Furthermore, the projecting end of the plunger 13 includes a plurality of spear pointed camming teeth 43. The sleeve 14, when telescoped into the bore of the plunger 13, has a plurality of rearwardly projecting camming teeth 42 which cooperate with the forwardly projecting camming teeth 43 on the plunger 13. In addition to the camming teeth of sleeve 14, the sleeve 14 also carries a plurality of latch dogs 44 projecting radially from alternate ones of the camming teeth, each of the dogs have a rear end of sawtooth form defining a camming ramp extending diagonally the full width of the dog. As shown in FIG. 1, a sleeve 14 carries four latch dogs 44 which engage alternately the four extended recesses or ways in barrel 11 and four partial recesses or ways which limit axial motion of sleeve 14 in an intermediate or off position and function as latching pockets.

In the retracted position of the sleeve 14, the latch dogs 44 are received in ways defined in the inner circumference of the barrel 11, these ways also serve to guide lugs 13A. At the forward or projecting end of the ways, diagonal shoulders define camming ramps. The outer diameter of the latch dogs on the sleeve 14 is greater than the inner diameter of shoulders in the camming ramps defined in the inner surface of the barrel 11. As a result, when the dogs of sleeve 14 are urged rearwardly by the coil spring 16, they engaged shoulders and camming action effects rotary indexing of the sleeve 14 to move the dogs into the latching pockets to establish a latched position of the switch. The dimensions of the ways and camming ramps associated with the outer surface of sleeve 14 establish the "OFF" position of the switch, in which the flange 19 achieves the "OFF" position illustrated in FIG. 4. A more complete description of the interaction of the lugs, latch dogs and various camming surfaces of the plunger 13, sleeve 14 and barrel 11 is found in parent application Ser. No. 873,030 which has been incorporated into the present application by reference thereto.

BEST MODE FOR CARRYING OUT THE INVENTION

For purposes of explanation only, a further preferred embodiment of the present invention will also be described in conjunction with a pushbutton switch assembly, wherein components similar to components already described in the first embodiment have been designated by the same material with a prefix "1" appearing therefore.

Figure 7:
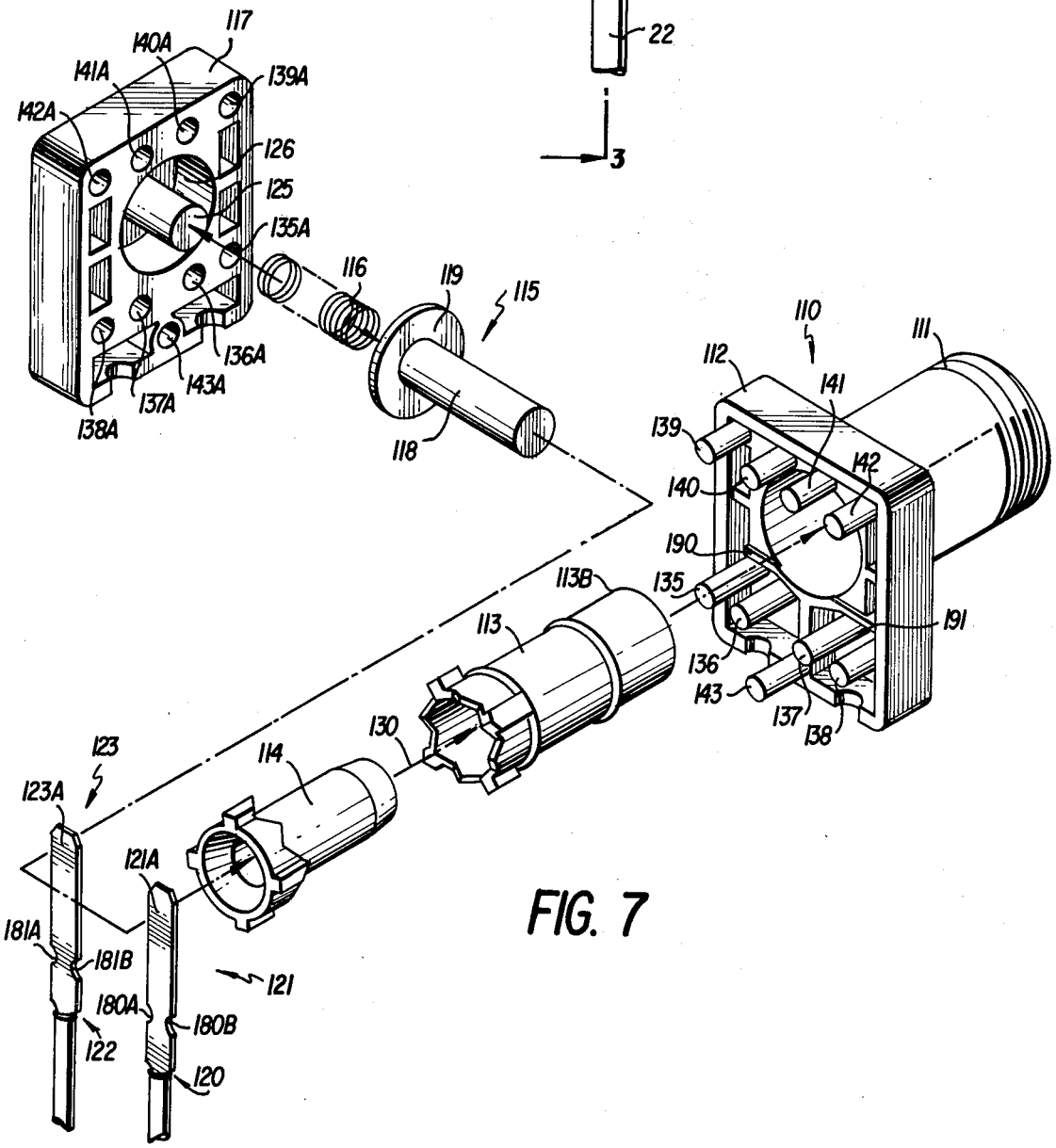
FIG. 7 is an exploded view of a pushbutton switch assembly incorporating a further, preferred embodiment of the present invention.
Figure 5:
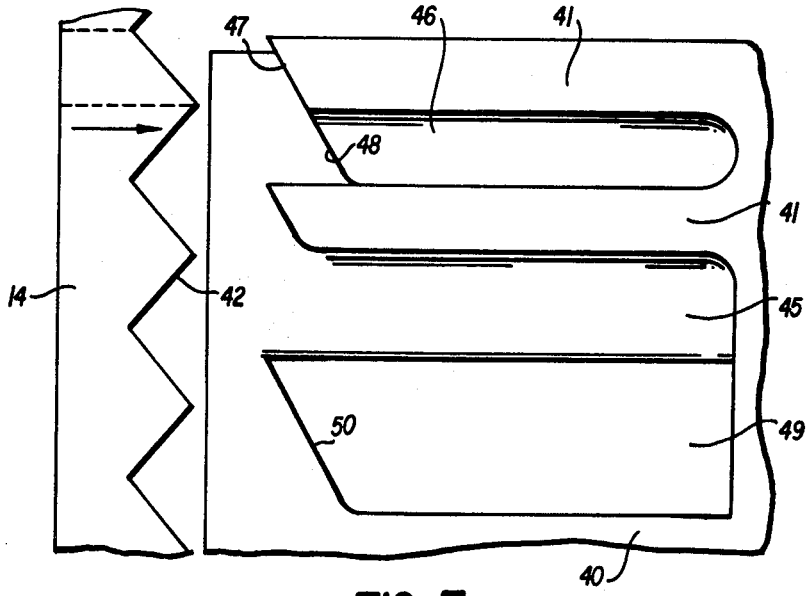
FIG. 5 is a developed view of the interior chamber of the barrel end ratchet assembly.
Figure 6:
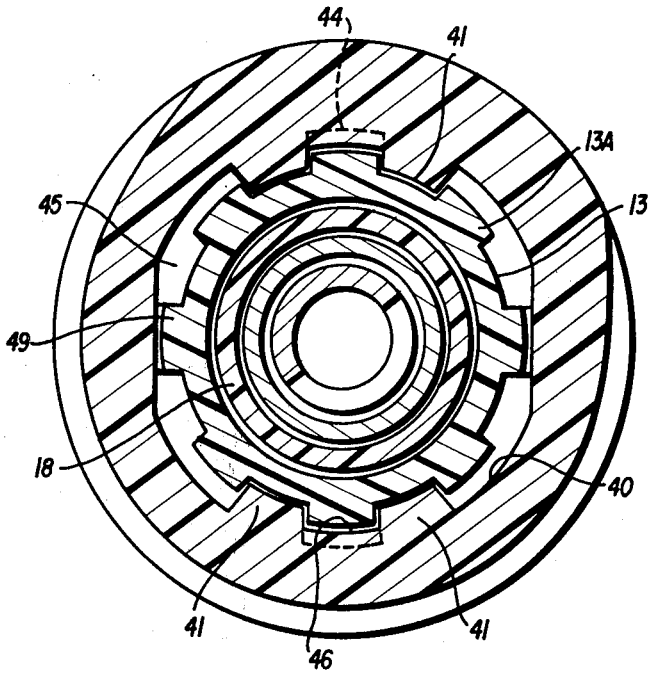
FIG. 6 is a cross-section taken along a line 5—5 in FIG. 2.

FIG. 7 is an exploded view of the several components of a switch assembly embodying a preferred embodiment of the present invention. More particularly, the switch comprises a housing 110 including an externally threaded barrel portion 111 having an axis 130, a head portion 112 attached to an end of barrel 111 and extending generally transverse to the axis 130. The head portion includes a plurality of pins 135–143, whose purpose will be discussed hereinafter. A generally cylindrical plunger 113 is arranged for sliding movement within the barrel 111 along the axis 130, with one end 113B available for projection along the axis 130. Fitted within the plunger 113 is a generally cylindrical sleeve 114 also aligned on axis 130 and arranged, by apparatus to be described, for motion longitudinal of the axis 130 and further arranged for rotational movement about the axis 130. A moveable contact 115 is arranged to fit within the cylindrical sleeve 114 for motion along the axis 130. The moveable contact 115 comprises a thimble-like contact having a generally cylindrical portion 118 and an annular flange 119 at one end thereof. A coil spring 116 is arranged within the cylindrical portion 118 of the moveable contact 115 to bear against the contact 115 and a guide stud 125. The guide stud 125 comprises a portion of a cover 117 and serves to partially define an annular recess 126 in the cover 117. Additionally recesses 135A–143A are included in the cover 117 for mating with the pairs of pins 135–143 of the head 112. An interference fit between the pins 135–143 and their corresponding recesses 135A–143A function to secure the cover 117 to the head 112 when the switch is assembled. Pins 135–138 form a first row while pins 140–142 form a second row. Pin 143 is non-aligned with either row of pins in order to ensure proper alignment of cover 117 with head 112.

The function of the switch is to selectively make or break an electrical connection between a pair of conductors, such as conductors 120 and 122. To this end, each of the conductors 120 and 122 includes a flat terminal end portion 121 and 123, respectively. Terminal end portions 121 and 123 are each retained within switch housing 110 by pairs of the pin members 135–136 or 137–138, with the terminal end portions serving as electrical contacts to selectively provide an electrical connection between conductors 120 and 122.

Contact terminals 121 and 123 may be integral extensions of conductor cables 120 and 122, or contact terminals 121 and 123 can be attached to conductors 120 and 122 via any type of conventional mechanical connection. If terminals 121 and 123 are integrally attached to conductors 120 and 122, the terminals may constitute coined end portions of the respective conductors. For example, contact terminals 121 and 123 may each be formed from a single strand of conductor wire which has been coined flat in a conventional process, which process, in itself, makes up no part of the present invention. Alternatively, each of the coined ends may be formed from a plurality of separate strands of tinned wire, which strands are tightly twisted together, overtinned and then coined flat into a substantially rectangular configuration.

As shown in FIG. 7, terminal 121 may include a contact portion 121A and an integrally attached conductor portion 121B, with conductor portion 121B attached to conductor wire 120. Likewise, terminal 123 may include a contact portion 123A and a conductor portion 123B integrally attached thereto, with conductor portion 123B attached to conductor wire 122. Finally, a pair of aligned notches or grooves 180A and 180B may be formed on opposite sides of terminal 121 and a similar pair of aligned notches or grooves 181A and 181B formed on opposite sides of terminal 123. Each pair of grooves is formed at the terminal end adjacent to the junction between the integrally attached contact and conductor portions 121A–121B and 123A–123B, respectively.

Figure 8:
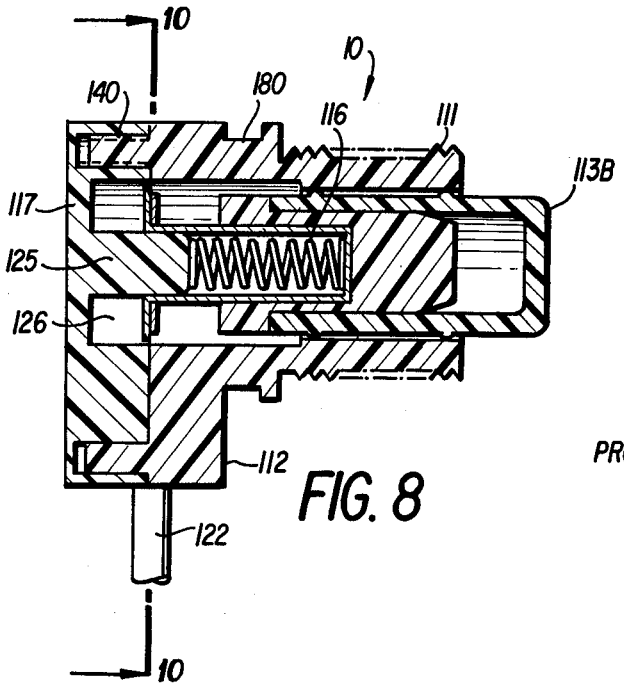
FIG. 8 is a cross-section of the switch assembly of FIG. 7 taken through an axis thereof.
Figure 9A:
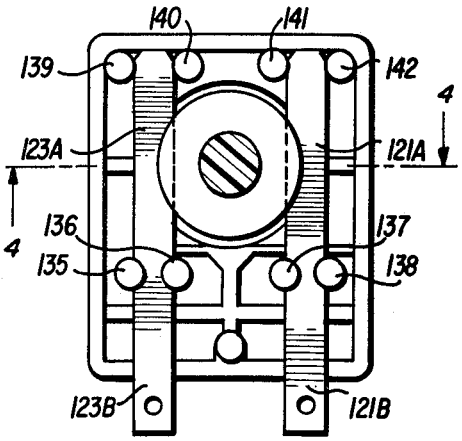
FIG. 9A is a cross-section taken on the lines 6—6 in FIG. 8.
Figure 9B:
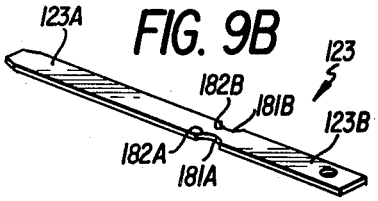
FIG. 9B is a perspective view of an integral electrical contact and conductor member as employed in the device of FIG. 9A.
Figure 10B:
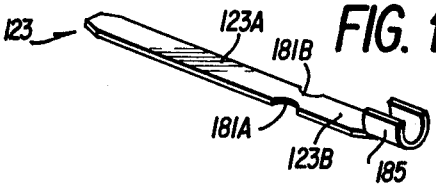
FIG. 10B is a perspective view of an integral electrical contact and conductor member as employed in the device of FIG. 10A.

Referring to FIG. 9A, it is noted that pins 135 and 136 extend on opposite sides of terminal 123, while pins 137 and 138 extend on opposite sides of terminal 121. Each pair or pins 135–136 and 137–138 extends substantially parallel to the other and is separated by a linear distance or gap appreciably narrower than the adjacent portions of the respective contact portions 123A and 121A. As a result, tensional stresses applied to conductor portions 123B and 121B function to draw the attached contact portion into abutment with a pair of pin members, thereby preventing withdrawal of the contact portion therebetween. The specific shape of the contact portions 123A and 121A need not be rectangular as shown in FIGS. 8, 9A and 9B. Rather, a terminal having almost any geometrical configuration could be employed, provided that the contact portion of the terminal has, at some point, a width which is appreciably greater than the transverse distance between its respective pair of pin members.

Figure 10A:
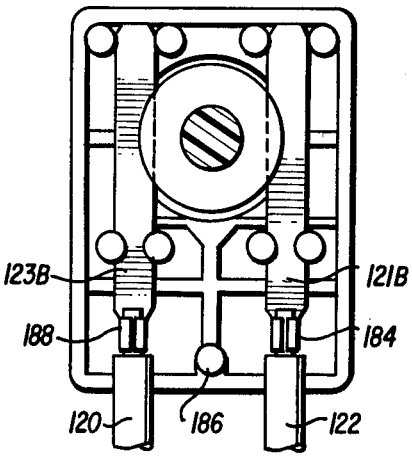
FIG. 10A is a section similar to FIG. 9A showing, however, a modified switch housing assembly.

In the embodiment shown in FIGS. 9A and 10A, the terminals 121 and 123 are each formed with a substantially uniformly rectangular configuration, wherein the entire width of each terminal is greater than the gap formed between its respective pair of pins 135–136 or 137–138. As a result, the pairs of grooves or notches allow insertion of the terminal between a pair of pin members.

Grooves 181A and 181B form a pair of shoulder portions 182A and 182B which extend outwardly from one another as measured in a direction extending away from conductor portion 123B. In a like manner, the grooves 180A and 180B each include oppositely directed shoulder portions which extend outwardly from one another. At their widest point, each pair of shoulder portions has a combined width which is appreciably greater than the transverse gap distance between pins 135–136 or 137–138, respectively. Contact between the shoulder portions of the terminal grooves and the adjacent pin members prevent the contact portion from being drawn through the gap due to stresses applied to the attached conductor.

As shown in FIG. 9A, conductor portions 121B and 123B can each extend through a separate opening formed in housing assembly 110, with each conductor portion engaging a separate conductor 120 or 122, of the type shown in FIG. 7. Alternatively, each conductor portion 121B and 123B may have a crimped end 184 and 185 as shown in FIG. 10A, wherein each crimped end is positioned within an additional recess formed in head portion 112 between the pins 135–138 and a side wall 186. Each conductor 120 and 122 extends through an opening in wall 186 of head portion 112 and is attached to one of the respective crimped ends. In order to ensure good electrical conductivity between the conductor portion 121B, 123B and the attached conductors 120, 122, the attached end portions are preferably soldered to one another.

As shown in FIGS. 7, 9A and 10A, each contact portion of the terminals 121 and 123 extends between a second pair of pins, 139–140 or 141–142. Pins 139 and 140 are transversely spaced from one another a distance substantially equal to the width of contact portion 123A as shown in FIG. 9A. Likewise, pins 141 and 142 are transversely spaced from one another a distance substantially equal to the width of contact portion 121A in FIG. 9. Each pair of pins 139–140 or 141–142 functions to prevent angular misalignment of its respective terminal by providing a pair of positive stops on either side of a respective terminal member.

As shown in FIG. 7, a pair of rib members 190 and 191 are attached to an interior surface of head portion 112, with each rib extending in a direction substantially transverse to the longitudinal axis of the terminals 121 and 123. Rib member 190 is positioned between the two pairs of pins 139–140 and 135–136 and proximate the latter pair, while rib member 191 is likewise positioned between the two pairs of pins 141–142 and 137–138 and proximate to pins 137–138. Each rib is formed of a crushable material which projects away from head portion 112. As head and cover portions 112 and 117 are brought into abutment with one another, cover portion 117 engages and presses terminals 121 and 123 into engagement with the respective rib member. Because the rib members are made of a crushable material, they will be deformed as the terminals are pressed into their assembled positions. The crushable ribs 190 and 191 serve to maintain a biasing force against the terminals to maintain the terminals in their properly aligned positions within housing 110, allowing head and cover portions 112 and 117 to be manufactured with less costly tolerences as compared to known prior art switch assemblies.

Figure 12:
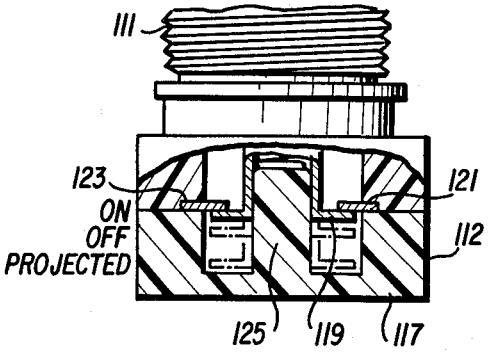
FIG. 12 is a section of the preferred embodiment taken on the lines 10—10 in FIG. 9A.

FIG. 8 is a cross-section of a preferred embodiment of the switch in the closed condition and FIG. 12 illustrates still another cross-section of the switch taken on the lines 10—10 in FIG. 9A. FIG. 12 illustrates the switch in the closed condition, wherein the flange 119 of the contact 115 bridges the contact portions 121A and 123A of the terminals to establish an electrical connection therebetween. The legend "ON" indicates that when the flanged end 119 is in the condition shown, an electrical connection exists between conductors 120 and 122. The adjacent dotted showing of flange 119, corresponding to the "OFF" legend, indicates that this is a second position of contact 115 wherein the switch is in the "OFF" condition. Finally, a second dotted showing of flange 119, associated with the legend "PROJECTED" indicates that as the plunger 113 is depressed, the flange 119 reaches the position shown. Actually, the contact 115 has two stable positions, the "ON" and "OFF" positions. The first of these positions is achieved through the action of the coil spring 116 biasing contact 15 against the stud 125. This biasing force establishes a solid electrical connection between the flange 119 and the terminals 121 and 123 attended to conductors 120 and 122 which is controlled by the spring design force. The stable "OFF" condition of the switch is achieved through the operation of a ratchet mechanism to be described hereinafter.

Figure 11A:
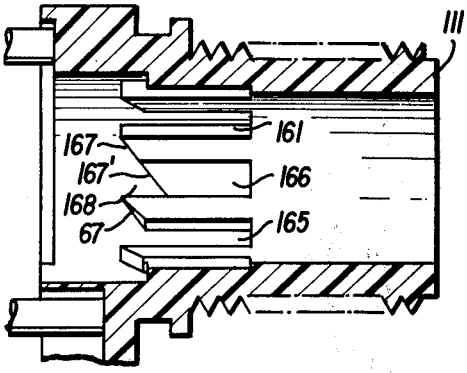
FIG. 11A is a cross-sectional view of the barrel end ratchet assembly employed in the preferred embodiment of FIG. 7.
Figure 11B:
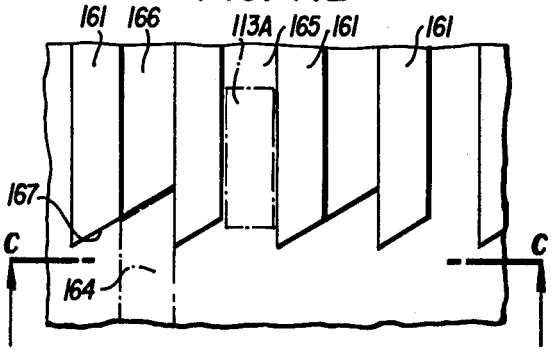
FIG. 11B is a partial blow-up of an interior wall portion of the barrel of FIG. 7.
Figure 11C:
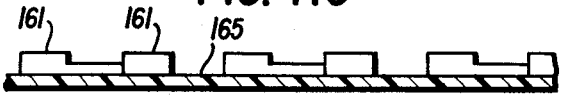
FIG. 11C is an interior view of the barrel taken on lines 9—9 of FIG. 11B.

As shown in FIG. 7, plunger 113 carriers a plurality of lugs 113A (as shown in FIG. 7, four lugs are provided). Corresponding extended recesses or ways are provided in the interior of the barrel 111 to allow the plunger 113 to move parallel to the axis 130, with the lugs preventing rotation of the plunger 113 as will be described. Futhermore, the projecting end of the plunger 113 includes a plurality of spear pointed camming teeth 163. The sleeve 114, when telescoped into the bore of the plunger 113, has a plurality of rearwardly projecting camming teeth 162 which cooperate with the forwardly projecting camming teeth 163 on the plunger 113. In addition to the camming teeth of sleeve 114, the sleeve 114 also carries a plurality of latch dogs 164 projecting radially from alternate ones of the camming teeth, with each of the dogs having a rear end of sawtooth form defining a camming ramp extending diagonally across an entire end portion of the dog. FIG. 11A shows barrel 111 with a plurality of splines or ribs 161 attached to and circumferentially spaced about an interior surface thereof, with ribs 161 extending into an interior chamber 160 formed by barrel 111. The lugs 113A are slidably received between diametrically opposed pairs of the spaced ribs 161, allowing free reciprocation of plunger 113 within barrel 111, while preventing rotation of plunger 113. Ribs 161 are formed with diagonal shoulders defining camming ramps 167. Likewise, a plurality of extended recesses or ways 165 are defined between alternately disposed pairs of adjacent ribs 161, with the remaining pairs of ribs defining more shallow recesses or ways 166. Each shallow recess or way 116 includes a camming ramp 167' which forms a continuation of ramp 167. Furthermore, each shallow recess 166 defines a latch pocket 168.

During operation, when sleeve 114 is in its retracted position, the latch dogs 164 are received in alternate ways 165, with the remaining ways 165 receiving lugs 113A. Projection of plunger 113 causes movement of sleeve 114 and the attached lug dogs 164 out of ways 165. Simultaneously, camming ramps 162 and 163 engage one another causing rotary indexing of sleeve 114 relative to plunger 113, which remains rotationally fixed due to lugs 113A remaining within ways 165. After pressure is removed from plunger 113, spring 116 functions to bias sleeve 114 and plunger 113 to their retracted position. However, because of the rotary indexing of sleeve 114 (due to the camming of camming ramps 162 and 163) the latch dogs 164 mounted on sleeve 114 are now aligned with latch pockets 168 formed by shallow ways 166, against the action of spring 116. This maintains the flange 119 in the position associated with the "OFF" legend in FIG. 12. A subsequent projection of plunger 113 functions to align latch dogs 164 once again with ways 165 allowing spring 116 to bias contact 115 into its retracted condition, wherein it bridges terminals 121 and 123.

As with the embodiment shown in FIG. 1, the preferred embodiment may also function as a "momentaryoff" type switch. In this embodiment, the contact 115 has only a single stable position, the "ON" position. Projection of the plunger results in projection of the flange 119 from the bridging position between terminals 121 and 123, but only for so long as the plunger 113 remains projected. As soon as the projecting force is removed from the plunger 113, the flange 119 returns to the solid line illustration in FIG. 12, again bridging the terminals 121 and 123. For this type of operation, rotary indexing of the sleeve 114 is to be prevented, to thus prevent the latch dogs 164 from being trapped in the latch pockets 168, restraining the sleeve against the action of the spring 116. This can be simply effected by limiting axial travel of sleeve 114 such that latching cannot occur.

Alternatively, the sleeve 114 can be omitted and plunger 113 increased in length with omission of camming teeth. When sleeve 114 is eliminated and greater plunger travel is required, a spring may be inserted to act between plunger 113 and contact 115, which spring overbalances spring 116 when plunger 113 is in the projected position.

Other modifications that can be employed to prevent a ratcheting operation will occur to those skilled in the art. Regardless of the manner in which it is effected, when rotary indexing of sleeve 114 is prevented, the switch will have only the single stable "ON" condition in which the flange 119 bridges the terminals 121 and 123. This condition will be maintained in the absence of a force exerted on the plunger 113 projecting the same. The switch will be in the "OFF" or open condition only for so long, as the force remains to maintain the plunger 113 in a projected condition.

Many modifications can be made to the preferred embodiments illustrated herein, which modifications will be obvious to those skilled in the art after reviewing this description. For example, while the terminal configuration illustrated herein has actually been employed in examples of switches that have been manufactured, it may well be preferable to have terminals projecting from other body locations or bent in various shapes for specific applications and additional plugs and recesses, for example, at the corners of head 112 and 117. While the barrel 111 is illustrated as carrying external threads which facilitates mechanical mounting of the switch, those skilled in the art will realize that this feature is not essential to the invention. For example, a circumferentially extending recess 180 can be formed in an outer surface of head 112 as shown in FIG. 8, wherein recess 180 is positionable within an opening formed in a support wall with the sides of recess 180 engaging opposite sides of the support wall. In view of the foregoing, the scope of the invention is to be defined by the claims appended hereto and not be the preferred embodiments discussed herein.

What is claimed is:

1. An assembly for maintaining proper positioning of a planar electrical terminal within a surrounding housing assembly of an electrically operated device, and comprising:

said housing assembly including first and second housing portions arranged in adjacently disposed relationship to one another;

said electrical terminal extending in a substantially single plane within said housing assembly and including a first portion forming an electrical attachment with an electrical conductor, with said terminal first portion extending beyond said housing;

pin means including a plurality of pin members each attached to one of said housing portions and extending into corresponding recess means formed in the remaining housing portion;

said pin means including at least one pair of spaced pin members arranged on opposite sides of said electrical conductor and in contact therewith, defining a distance between said pin members which is appreciably less than a width of a second portion of said planar electrical terminal positioned on an opposite side of said pair of pin members from said first portion of the terminal which extends beyond said housing, thereby preventing withdrawal of said planar electrical terminal between said pair of spaced pin members;

one of said housing portions further including retaining means for preventing angular movement of said second portion of said planar electrical terminal in a plane extending transversely through said spaced pin members; and said housing portions including means for restricting motion of said second portion of said planar electrical terminal in a direction perpendicular to said transversely extending plane through said spaced pin members.

2. An assembly according to claim 1, wherein a plurality of separate planar electrical terminals are each positioned between said first and second housing portions, at least one of said planar electrical terminals includes a portion forming an electrical attachment with a separate electrical conductor.

3. An assembly according to claim 2, wherein said pin means comprises a plurality of pairs of pin members extending from one of said housing portions into a plurality of recesses formed in said remaining housing portion, with at least one pair of said spaced pin members arranged on opposite sides of said at least one planar electrical terminal forming an electrical attachment with said separate electrical conductor.

4. An assembly according to claim 1, wherein said electrical terminal constitutes a coined end portion of said electrical conductor assembly.

5. An assembly according to claim 1, wherein said retaining means comprises a shallow recess formed in a surface of one of said housing portions, said shallow recess having a portion formed with a cross-sectional configuration sufficiently similar to a cross-sectional configuration of said electrical terminal for preventing angular movement of said planar electrical terminal when it is positioned in said shallow recess, whereby side wall portions of said shallow recess abut sides of said planar electrical terminal to prevent angular movement of said terminal.

6. An assembly according to claim 1, wherein a plurality of separate planar extending electrical terminals are each positioned between said first and second housing portions, with of said planar extending electrical terminals including a portion forming an electrical attachment with a separate electrical conductor.

7. An assembly according to claim 6, wherein said pin means comprises a plurality of pairs of pin members each extending from one of said housing portions into one of a plurality of recesses formed in said remaining housing portion, at least one pair of said spaced pin members being arranged on opposite sides of each of said plurality of separate planar extending electrical terminals.

8. An assembly according to claim 7, wherein each pair of spaced pin members defines a distance appreciably less than a width of a portion of a respective planar extending electrical terminal positioned on an opposite side of said respective pair of pin members from that portion of the conductor extending beyond said housing attached to one of the conductors.

9. An assembly according to claim 6, wherein said retaining means comprises a plurality of shallow recesses each formed in a surface of one of said housing portions, each shallow recess having a portion formed with a cross-sectional configuration sufficiently similar to a cross-sectional configuration of said plurality of planar electrical terminals for preventing angular movement of said planar electrical terminals when each is positioned in a separate one of said shallow recesses, whereby side wall portions of each shallow recess abut sides of a respective planar terminal to prevent angular movement of said respective terminal.

10. An assembly for preventing inadvertent withdrawal of a pair of electrical terminals from a pushbutton switch assembly, and comprising:

a pair of electrical terminals;

a housing assembly including a barrel portion with an axis and an attached head portion extending generally transverse to said axis;

a cover portion positioned adjacent to said head portion with each of said electrical terminals extending in non-contacting relationship to one another between said head and cover portions, each of said terminals having an end portion forming an electrical attachment with an electrical conductor extending beyond said housing;

a plurality of spaced pin members each extending between said head and cover portions with at least one pair of pin members arranged on opposite sides of and in contact with each of said electrical terminals;

each pair of spaced pin members defining a distance which is appreciably less than a width of a further portion of a respective electrical terminal from that portion of the same electrical terminal forming an electrical attachment with a one of said electrical conductors;

said head and cover portions of said housing further include insulating means for preventing an electrical connection between said conductors through either said head or said cover portion;

a contact moveable along said axis for bridging said electrical terminal for electrically connecting said conductors attached thereto;

means mounting said contact for said axial movement to establish said electrical connection;

a plunger axially slidable in said barrel and engaging said means for projecting said mounting means in an axial direction;

biasing means yieldably biasing said contact, mounting means and plunger for return to a retracted position in which said contact bridges said conductors;

a ratchet mechanism on said housing and mounting means for retaining said mounting means in a projected position against the bias of said biasing means;

said plunger transmitting axial motion to said mounting means on a first stroke for operating said ratchet mechanism to retain said mounting means in a projected position at the conclusion of said stroke in which position said contact is out of engagement with said terminals;

said plunger transmitting axial motion to said mounting means on a second stroke for operating said ratchet mechanism to allow said biasing means to return said contact and mounting means to a retracted position, in which said contact is in engagement with said terminals.

11. An assembly for preventing inadvertent withdrawal of a pair of electrical terminals from a pushbutton switch assembly, and comprising:

a pair of electrical terminals;

a housing assembly including a barrel portion with an axis and an attached head portion extending generally transverse to said axis;

a cover portion positioned adjacent to said head portion with each of said electrical terminals extending in non-contacting relationship to one another between said head and cover portions, each of said terminals having an end portion forming an electrical attachment with an electrical conductor extending beyond said housing;

a plurality of spaced pin members each extending between said head and cover portions with at least one pair of pin members arranged on opposite sides of and in contact with each of said electrical terminals;

each pair of spaced pin members defining a distance which is appreciably less than a width of a further portion of a respective electrical terminal from that portion of the same electrical terminal forming an electrical attachment with a one of said electrical conductors;

said head and cover portions of said housing further include insulating means for preventing an electrical connection between said conductors through either said head or said cover portion;

a contact moveable along said axis for selectively bridging said electrical terminal for electrically connecting said conductors attached thereto;

means mounting said contact for said axial movement to establish said electrical connection;

a plunger axially slidable in said barrel and engaging said means for projecting said mounting means in an axial direction;

biasing means yieldably biasing said contact, mounting means and plunger for return to a retracted position in which said contact is out of engagement with said conductors;

a ratchet mechanism on said housing and mounting means for retaining said mounting means in a projected position against the bias of said biasing means;

said plunger transmitting axial motion to said mounting means on a first stroke for operating said ratchet mechanism to retain said mounting means in a projected position at the conclusion of said stroke in which position said contact bridges said terminals to form an electrical connection therebetween;

said plunger transmitting axial motion to said mounting means on a second stroke for operating said ratchet mechanism to allow said biasing means to return said contact and mounting means to a retracted position, in which said contact is out of engagement with said terminals.

* * * * *